US009290345B2

(12) United States Patent
Doyo

(10) Patent No.: US 9,290,345 B2
(45) Date of Patent: Mar. 22, 2016

(54) SHEET CONVEYING DEVICE AND IMAGE FORMING APPARATUS INCLUDING SHEET CONVEYING DEVICE

(71) Applicant: KYOCERA Document Solutions Inc., Osaka-shi, Osaka (JP)

(72) Inventor: Hideaki Doyo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/031,350

(22) Filed: Sep. 19, 2013

(65) Prior Publication Data

US 2014/0077443 A1 Mar. 20, 2014

(30) Foreign Application Priority Data

Sep. 20, 2012 (JP) ..... 2012-206927

(51) Int. Cl.
*B65H 9/00* (2006.01)
*B65H 5/06* (2006.01)
*B65H 5/38* (2006.01)

(52) U.S. Cl.
CPC ..... *B65H 5/068* (2013.01); *B65H 5/062* (2013.01); *B65H 5/38* (2013.01); *B65H 9/00* (2013.01); *B65H 9/006* (2013.01); *B65H 2404/512* (2013.01); *B65H 2404/6111* (2013.01); *B65H 2601/521* (2013.01)

(58) Field of Classification Search
CPC ..... B65H 5/00; B65H 5/062; B65H 2301/31124; B65H 2301/31122; B65H 2601/521
USPC ..... 271/9.13, 225, 10.11; 399/388
See application file for complete search history.

(56) References Cited

U.S. PATENT DOCUMENTS

| | | | | |
|---|---|---|---|---|
| 5,646,720 | A * | 7/1997 | Song | 399/361 |
| 5,913,511 | A * | 6/1999 | Miyauchi | 271/9.09 |
| 6,273,414 | B1 * | 8/2001 | Matsuo | 271/9.11 |
| 7,661,673 | B2 * | 2/2010 | Doyo | 271/264 |
| 2001/0017439 | A1 | 8/2001 | Hiramatsu | |
| 2008/0179819 | A1 * | 7/2008 | Tsai et al. | 271/145 |

(Continued)

FOREIGN PATENT DOCUMENTS

| | | |
|---|---|---|
| JP | H 10-35946 | 10/1998 |
| JP | 3653473 | 3/2005 |

(Continued)

OTHER PUBLICATIONS

Japanese Patent Appl. No. 2012-206927—Japanese Office Action issued on Dec. 17, 2014.

*Primary Examiner* — Jeremy R Severson
(74) *Attorney, Agent, or Firm* — Gerald E. Hespos; Michael J. Porco; Matthew T. Hespos

(57) ABSTRACT

A sheet conveying device that conveys a sheet includes a sheet conveying path, a conveying mechanism, and a guiding plate. The sheet conveying path is set to include a nonlinear portion. The conveying mechanism is arranged in the sheet conveying path to convey a sheet. The guiding plate is arranged in the nonlinear portion of the sheet conveying path and has a guiding plane along which the sheet is guided. The guiding plate includes a thinned portion in an area of the guiding plane against which a leading end of the sheet being conveyed along the sheet conveying path collides so that the thinned portion suppresses high frequency components of an impulsive sound produced by the collision.

13 Claims, 10 Drawing Sheets

(56) References Cited

U.S. PATENT DOCUMENTS

| | | | | |
|---|---|---|---|---|
| 2008/0251991 | A1 | 10/2008 | Doyo | |
| 2010/0225054 | A1* | 9/2010 | Jensen | 271/272 |
| 2011/0062661 | A1* | 3/2011 | Shimonaga | B41J 3/60 271/272 |
| 2013/0249161 | A1* | 9/2013 | Uchino | 271/9.01 |
| 2014/0084532 | A1* | 3/2014 | Asakawa | 271/11 |
| 2014/0084537 | A1* | 3/2014 | Shimizu et al. | 271/264 |
| 2014/0092188 | A1* | 4/2014 | Ota et al. | 347/104 |
| 2015/0098741 | A1* | 4/2015 | Endo | G03G 15/235 399/364 |

FOREIGN PATENT DOCUMENTS

| | | |
|---|---|---|
| JP | 2006-16094 | 1/2006 |
| JP | 3827026 | 7/2006 |
| WO | 2009109002 | 9/2009 |

* cited by examiner

SHEET CONVEYING DEVICE AND IMAGE FORMING APPARATUS INCLUDING SHEET CONVEYING DEVICE

The application is based on Japanese Patent Application No. 2012-206927 filed on the Japan Patent Office on Sep. 20, 2012, the contents of which are incorporated herein by reference.

BACKGROUND

The present disclosure relates to a sheet conveying device including a sheet conveying path set to include a nonlinear portion, for example, a curved conveying path, and an image forming apparatus including the sheet conveying device.

In an image forming apparatus such as a printer, a copier, or a facsimile machine, an apparatus main body contains a sheet conveying path along which a sheet is conveyed from a sheet feeding section to a sheet discharge section via an image forming section and a fixing section so that an image forming process is carried out on the sheet. The sheet conveying path often includes a U-curved portion due to a limitation on the device layout in the apparatus main body and the need for a reduction in apparatus size. In this case, a leading end of a sheet being conveyed collides against a guiding surface defining the curved sheet conveying path, and then, the sheet is conveyed along the guiding surface. An impulsive sound is produced when the leading end of the sheet collides against the guiding surface. Such an impulsive sound is unpleasant for a user. In particular, such a high-speed machine as is capable of processing more than 50 sheets per minute repeats producing an impulsive sound at a short period, further increasing an unpleasant feeling.

Several techniques have been proposed which mitigate the noise associated with sheet conveyance. For example, in a one structure, a conveyance assisting member that guides the leading end of a sheet is fixed to the guiding surface using an impact absorbing member. In another structure, a protruding portion is provided on a central portion of the guiding surface in a sheet width direction, with a resin sheet stuck to the protruding portion. In yet another structure, a leading end portion of a conveyance guide is covered with a resin sheet.

However, these structures are insufficient for suppressing the impulsive sound produced when the leading end of the sheet collides against the guiding surface. Furthermore, another member with impact absorption needs to be added to the sheet conveying path, disadvantageously increasing the number of components of the apparatus.

An object of the present disclosure is to provide a sheet conveying device that can suppress the impulsive sound produced during sheet conveyance as much as possible and an image forming apparatus including the sheet conveying device.

SUMMARY

A sheet conveying device according to an aspect of the present disclosure includes a sheet conveying path, a conveying mechanism, and a guiding plate. The sheet conveying path is set to include a nonlinear portion. The conveying mechanism is arranged in the sheet conveying path to convey a sheet. The guiding plate is arranged in the nonlinear portion of the sheet conveying path and has a guiding plane along which the sheet is guided. The guiding plate includes a thinned portion in an area of the guiding plane against which a leading end of the sheet being conveyed along the sheet conveying path collides so that the thinned portion suppresses high frequency components of an impulsive sound produced by the collision.

An image forming apparatus according to another aspect of the present disclosure includes an image forming section that forms an image on a sheet and a sheet conveying device that conveys a sheet via the image forming section. The sheet conveying device is configured as explained above.

DETAILED DESCRIPTION

Figure 1:
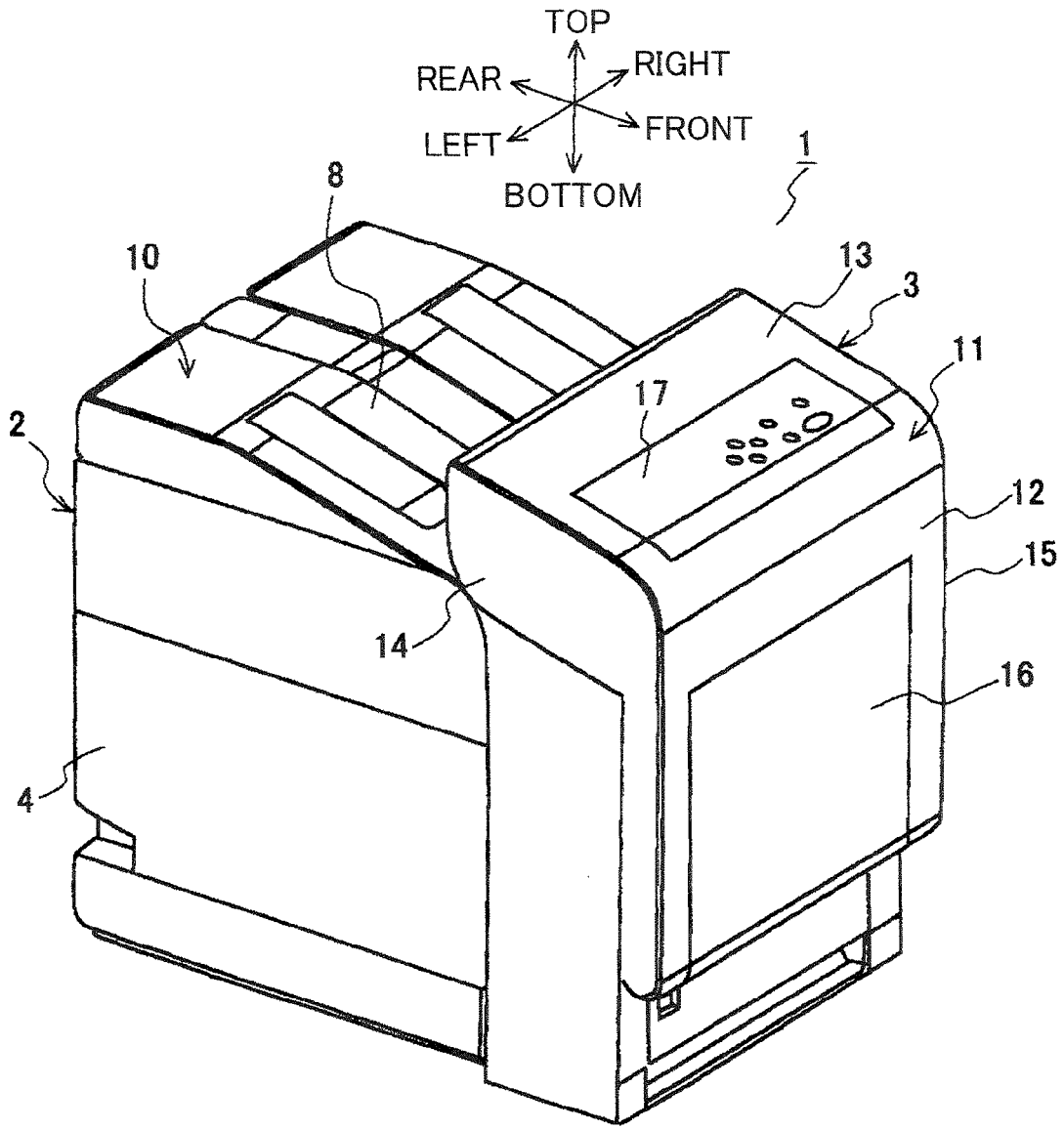
FIG. 1 is a general perspective view of an image forming apparatus according to an embodiment of the present disclosure viewed from an obliquely front and upper left side of the apparatus.
Figure 2:
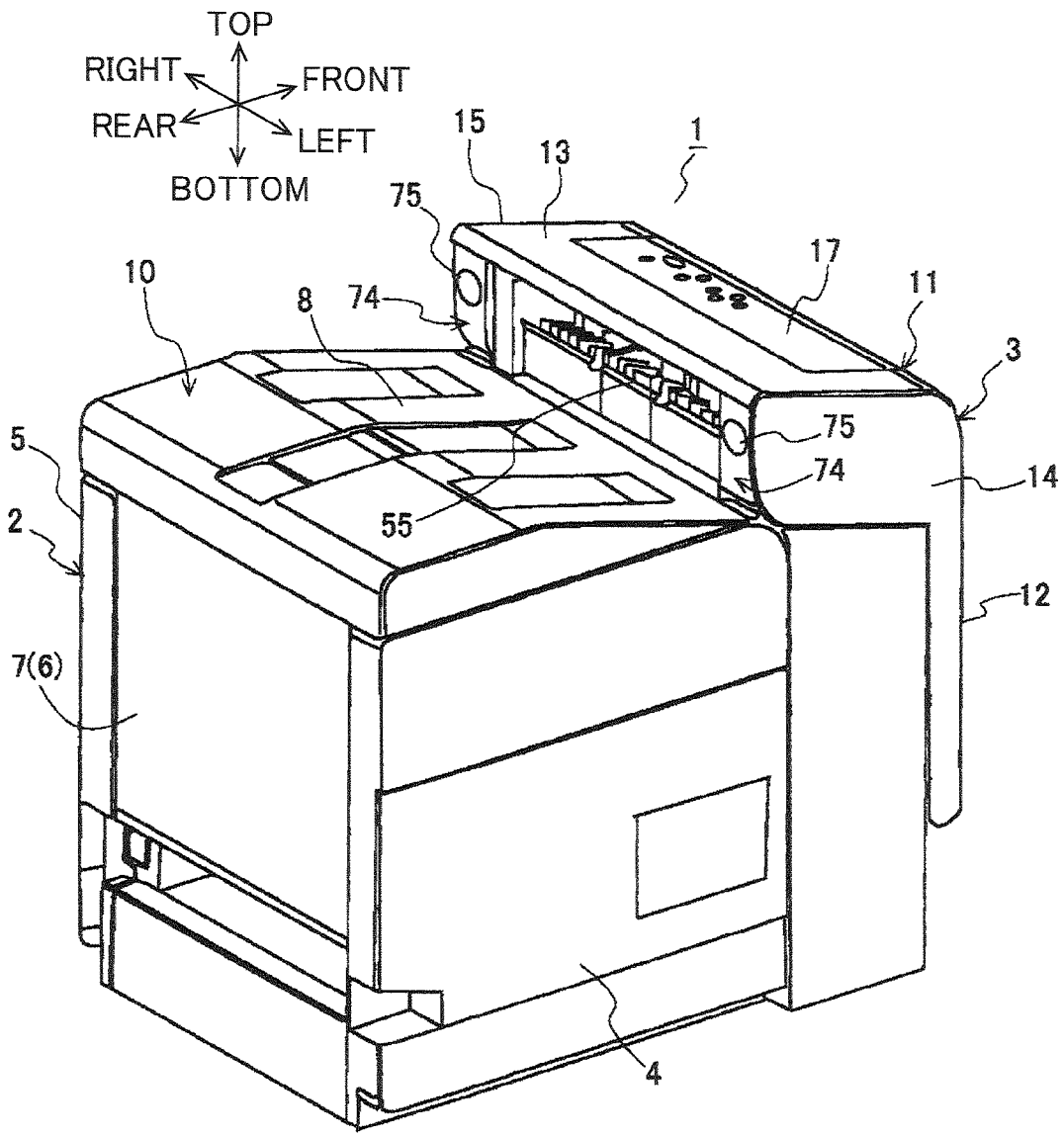
FIG. 2 is a general perspective view of the image forming apparatus viewed from an obliquely rear and upper left side of the apparatus.
Figure 3:
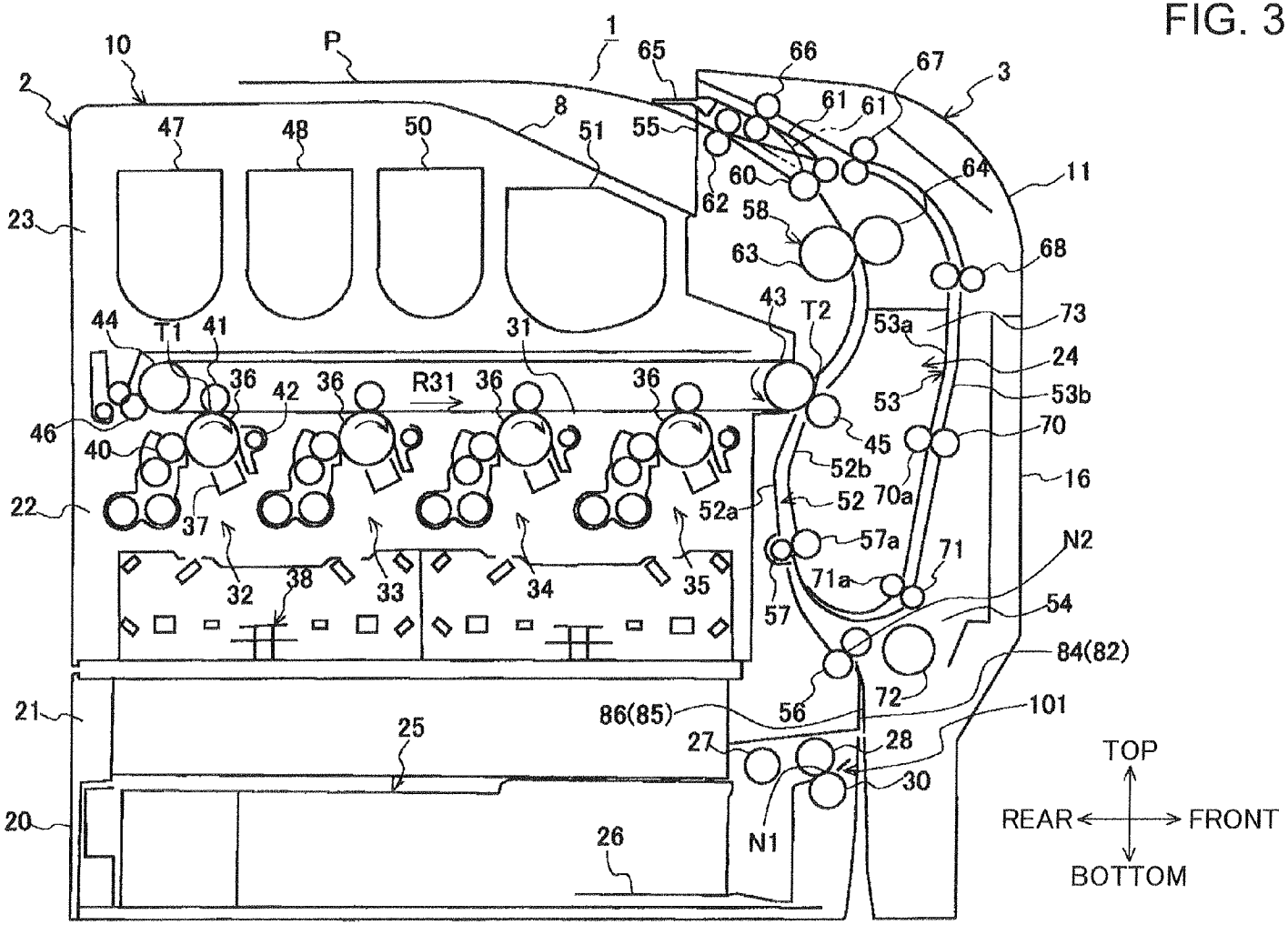
FIG. 3 is a cross-sectional view schematically showing the internal structure of the image forming apparatus.

An embodiment of the present disclosure will be described below with reference to the drawings. First, with reference to FIG. 1 to FIG. 3, an image forming apparatus 1 will be described, which includes a sheet conveying device 100 according to an embodiment of the present disclosure. FIG. 1 to FIG. 3 show an up-down direction, a front-back direction, and a lateral direction in the image forming apparatus 1 by arrows. FIG. 1 is a perspective view of the entirety of the image forming apparatus 1 viewed from an obliquely front and upper left side of the apparatus. FIG. 2 is a perspective view of the entirety of the image forming apparatus 1 viewed from an obliquely rear and upper left side of the apparatus. FIG. 3 is a diagram schematically showing the internal structure of the image forming apparatus 1 viewed from a left side of the apparatus.

Examples of the image forming apparatus 1 may include a printer, a copier, a facsimile machine, and a multifunction printer with the functions of a printer, a copier, and a facsimile machine. The image forming apparatus 1 is hereinafter a printer by way of example. The image forming apparatus 1 shown in FIG. 1 to FIG. 3 is a four-color (full-color) image forming apparatus of an electrophotographic type, an intermediate transfer type, and a tandem type.

The image forming apparatus 1 includes an apparatus main body 2 with an approximately box-like (rectangular parallelepiped-like) outer shape and a front cover 3 supported by the apparatus main body 2 so as to be openable and closable. The apparatus main body 2 is covered with a front cover 3 at a front side thereof and with a left outer panel 4 and a right outer panel 5 at a left side and a right side thereof. A rear plate 7 that is a part of a main body frame 6 formed of sheet metal is exposed from a rear surface of the apparatus main body 2. The apparatus main body 2 is covered with the front cover 3 at the top thereof and with a sheet discharge tray 10 with a rearward rising sheet loading surface 8 in an area from an intermediate portion to a rear portion of the apparatus main body 2.

The front cover 3 includes a front outer panel 11 and a part of a sheet conveying section 24 (see FIG. 3), described later, incorporated inside the front outer panel 11. The front outer panel 11 includes a front panel 12, an upper panel 13 which is continuous from an upper end of the front panel 12 and which rises rearward, and a left panel 14 and a right panel 15 which are inverted L shaped, the front panel 12, the upper panel 13, the left panel 14, and the right panel 15 being integrated with one another.

A rectangular manual insertion tray 16 is disposed in the front panel 12. The manual insertion tray 16 is rotationally movably attached to the apparatus main body 2 at a lower end thereof and can assume a closed posture and an open posture with respect to the apparatus main body 2. FIG. 1 shows that the manual insertion tray 16 is in the closed posture, in which the manual insertion tray 16 forms a part of the front panel 12. On the other hand, in the open posture, in which an upper end side of the manual insertion tray 16 is withdrawn forward (see FIG. 6), a sheet is loaded on an upper surface of the manual insertion tray 16, which is thus used as a sheet feeding tray.

An operation panel 17 is arranged on the upper panel 13 to accept input operation information. The operation panel 17 includes a touch-panel liquid crystal display section and various buttons arranged thereon. The left panel 14 and the right panel 15 are disposed to cover a part of the sheet conveying section 24 provided inside the front cover 3, from the left side and the right side, respectively.

A user can perform all of operations in general of the image forming apparatus 1 using the operation panel 17, a jam process for eliminating a jam, supply of sheets to the a sheet feeding cassette 25, and the like, from a front side of the image forming apparatus 1.

Now, with reference to FIG. 3, the internal structure of the image forming apparatus 1 will be described. The image forming apparatus 1 includes, in order from the bottom to the top of the apparatus main body 2, a sheet housing section 20, a board housing section 21, an image forming section 22, a toner refilling section 23, and the sheet discharge tray 10. Furthermore, the sheet conveying section 24 is disposed between the front side of the apparatus main body 2 and the front cover 3.

The sheet feeding cassette 25 is disposed in the sheet housing section 20. The sheet feeding cassette 25 houses a plurality of stacked sheets and has a lift plate 26 provided at a bottom portion of the cassette 25 to bias a leading end side (the right side in FIG. 3) of the stacked sheets upward. The uppermost sheet in the sheet feeding cassette 25 is picked up by a pickup roller 27. A pair of rollers including a sheet feeding roller 28 and a retard roller 30 is arranged downstream of the pickup roller 27. The sheet feeding roller 28 and the retard roller 30 have a function to prevent overlapping of sheets and feed only one sheet downstream.

The board housing section 21 includes a board, power units, and other components (not shown in the drawings) disposed therein; electronic components are mounted on the substrate to control operation of the image forming apparatus 1, and the power units supply power to sections of the image forming apparatus 1.

The image forming section 22 carries out a process of forming a toner image on a sheet, and includes an intermediate transfer belt 31 and four (four-color) image forming stations arranged along a rotating direction (the direction of arrow R31) of the intermediate transfer belt 31. The four image forming stations include a yellow (Y) image forming station 32, a magenta (M) image forming station 33, a cyan (C) image forming station 34, and a black (Bk) image forming station 35.

The yellow image forming station 32 includes a photosensitive drum 36, and a charging device 37, an exposure device 38, a developing device 40, a primary transfer roller 41, and a drum cleaner 42 disposed peripherally along a rotating direction (the direction of a corresponding arrow) of the photosensitive drum 36. The photosensitive drum 36 bears an electrostatic latent image and a toner image on a peripheral surface thereof and is rotationally driven in the direction indicated by the arrow in the figure at a predetermined process speed. The charging device 37 uniformly charges the peripheral surface of the photosensitive drum 36 at a predetermined polarity and a predetermined potential. The exposure device 38 irradiates the peripheral surface of the photosensitive drum 36 with laser light based on image information transmitted by a personal computer (not shown in the drawings) or the like to form an electrostatic latent image on the peripheral surface. The developing device 40 supplies toner to the peripheral surface of the photosensitive drum 36 to develop the electrostatic latent image, thus forming a toner image on the peripheral image.

The intermediate transfer belt 31 is passed around a driving roller 43 and a driven roller 44 and is driven in the direction of arrow R31 by rotation of the driving roller 43 in the direction of the corresponding direction. The photosensitive drum 36 and a primary transfer roller 41, arranged across the intermediate transfer belt 31, form a primary transfer section T1. A yellow toner image formed on the peripheral surface of the photosensitive drum 36 is primarily transferred onto the intermediate transfer belt 31 by means of the primary transfer section T1. The drum cleaner 42 removes toner remaining on the peripheral surface of the photosensitive drum 36 after the primary transfer of the toner image.

The image forming stations 33, 34, and 35 for the remaining three colors (cyan, magenta, and black) are configured similarly to the yellow image forming station 32. Toner images in cyan, magenta, and black are similarly formed on the peripheral surfaces of the photosensitive drums 36 of the image forming stations 33, 34, and 35, respectively, and sequentially primary-transferred to the same position on the intermediate transfer belt 31. Thus, the toner images in the four colors are superimposed on the intermediate transfer belt 31 to form a toner image in full colors on the intermediate transfer belt 31.

A secondary transfer roller 45 is arranged opposite the driving roller 43. The driving roller 43 and the secondary transfer roller 45, arranged across the intermediate transfer belt 31, form a secondary transfer section T2. In the secondary transfer section T2, the full color toner image borne on the intermediate transfer belt 31 is secondarily transferred to a sheet conveyed by the sheet conveying section 24. Toner remaining on the surface of the intermediate transfer belt 31 after the secondary transfer of the toner image is removed by a belt cleaner 46 arranged near the driven roller 44.

The toner refilling section 23 includes four toner containers, that is, a yellow toner container 47, a magenta toner container 48, a cyan toner container 50, and a black toner container 51 disposed therein to house toners in the respective colors.

The sheet discharge tray 10 is formed to cover the upper surface of the apparatus main body 2. A sheet discharged backward through a sheet discharge port 55 of the sheet conveying section 24 described below is loaded on the sheet loading surface 8 on an upper surface of the sheet discharge tray 10.

According to the present embodiment, the sheet conveying section 24 is provided between the front side of the apparatus main body 2 and the front cover 3. The sheet conveying section 24 has a sheet conveying path 52 along which a sheet is guided from a lower side to an upper side, an inverted conveying path 53 disposed in front of the sheet conveying path 52 and along which a sheet is guided from the upper side to the lower side, and a manual sheet feeding section 54. The inverted conveying path 53 is a sheet conveying path directly opened by opening the front cover 3. Furthermore, the sheet conveying path 52 is indirectly opened via a conveying unit 73 described below by opening the front cover 3.

The sheet conveying path 52 extends upward from the vicinity of the sheet feeding roller 28, continues extending upward while curving gently so as to protrude backward, continues extending upward with the curving direction changed to the forward direction in the vicinity of the intermediate transfer belt 31, continues extending obliquely upward but backward, and reaches the sheet discharge port 55. The sheet conveying path 52 includes a rear side guide 52*a* and a front side guide 52*b* arranged opposite each other. A portion of the front side guide 52*b* is formed in the conveying unit 73 described below.

The pickup roller 27, the pair of the sheet feeding roller 28 and the retard roller 30, a pair of conveying rollers 56, a pair of registration rollers 57, the driving roller 43 and secondary transfer roller 45 forming the above-described secondary transfer section T2, a pair of fixing rollers 58, a pair of conveying rollers 60, a switching flapper 61, and a pair of sheet discharge rollers 62 are arranged in the sheet conveying path 52, in this order from the bottom of the apparatus. The pair of fixing rollers 58 has a fixing roller 63 with a built-in heater (not shown in the drawings) and a pressurization roller 64 brought into abutting contact with the fixing roller 63 to form a fixing nip portion.

A sheet fed from the sheet feeding cassette 25 is conveyed to the secondary transfer section T2 by the pair of conveying rollers 56 and the pair of registration rollers 57. Subsequently, in the secondary transfer section T2, toner images in the four colors on the intermediate transfer belt 31 are secondarily transferred to the sheet, and then the sheet is conveyed to the fixing nip portion. The sheet is heated and pressurized while passing through the fixing nip portion, with the toner image fixed to the sheet.

The sheet with the toner image fixed thereto is guided to a lower surface of the switching flapper 61 by the pair of conveying rollers 60 and then conveyed to the pair of sheet discharge rollers 62. The sheet is further discharged backward by the pair of sheet discharge rollers 62 through the sheet discharge port 55, facing backward, and then loaded onto the sheet loading surface 8 of the sheet discharge tray 10. FIG. 3 shows that a sensor flag 65 of a sheet discharge sensor arranged immediately downstream of the pair of sheet discharge rollers 62 is moved by a sheet P being discharged.

The inverted conveying path 53 extends from a position slightly above the sheet discharge port 55 so as to incline forward, curves gently and then inclines steeply backward, and joins to the sheet conveying path 52 at a lower end portion of the inverted conveying path 53 while protruding downward. The inverted conveying path 53 includes a rear side guide 53*a* and a front side guide 53*b* arranged opposite each other. A portion of the rear side guide 53*a* is formed in the conveying unit 73. Furthermore, most of the front side guide 53*b* is incorporated inside the front outer panel 11 (on the rear end side of the outer panel 11). A pair of inversion rollers 66, a switching flapper 61, a first pair of inverted transfer rollers 67, a second pair of inverted transfer rollers 68, a third pair of inverted transfer rollers 70, and a fourth pair of inverted transfer rollers 71 are arranged in the inverted conveying path 53, in this order from the upper side, corresponding to an upstream side during inverted transfer of a sheet.

When images are formed on the respective opposite surfaces of a sheet, the switching flapper 61 is switched to a position shown by a chain double-dashed line. A sheet with an image fixed to a front surface thereof is conveyed to the pair of conveying rollers 60 and then along an upper surface of the switching flapper 61, and is then conveyed backward by the pair of inversion rollers 66. A trailing end of the sheet passes through the pair of conveying rollers 60, and then, the pair of inversion rollers 66 is reversely rotated before the trailing end of the sheet passes through the pair of inversion rollers 66. The sheet is then conveyed downward to the sheet conveying path 52 by the first to fourth inverted transfer rollers 67, 68, 70, and 71. Then, a toner image is transferred and fixed to a back surface of the sheet as is the case with the front surface. Subsequently, the sheet is discharged backward through the sheet discharge port 55 and loaded onto the sheet loading surface 8 of the sheet discharge tray 10.

A manual sheet feeding roller 72 is disposed immediately in front of the pair of conveying rollers 56 in the sheet conveying section 24. A sheet set on the manual insertion tray 16 is fed toward the pair of conveying rollers 56 by the manual sheet feeding roller 72.

The sheet conveying section 24 is partly formed of the openable and closable conveying unit 73. The conveying unit 73 is arranged between the sheet conveying path 52 and the inverted conveying path 53 and includes a part of the front side guide 52*b* of the sheet conveying path 52 and a part of the rear side guide 53*a* of the inverted conveying path 53. Furthermore, the conveying unit 73 supports a roller 57*a* of the pair of registration rollers 57, the secondary transfer roller 45, and the other rollers 70*a* and 71*a* of the third inverted conveying rollers 70 and the fourth inverted conveying rollers 71. The conveying unit 73 has a center of swing at a lower end side thereof and is openably and closably supported by the apparatus main body 2. The front cover 3 is opened to open an upper end side of the conveying unit 73 forward and thus to open a part of the sheet conveying path 52 and a part of the inverted conveying path 53.

Figure 4:
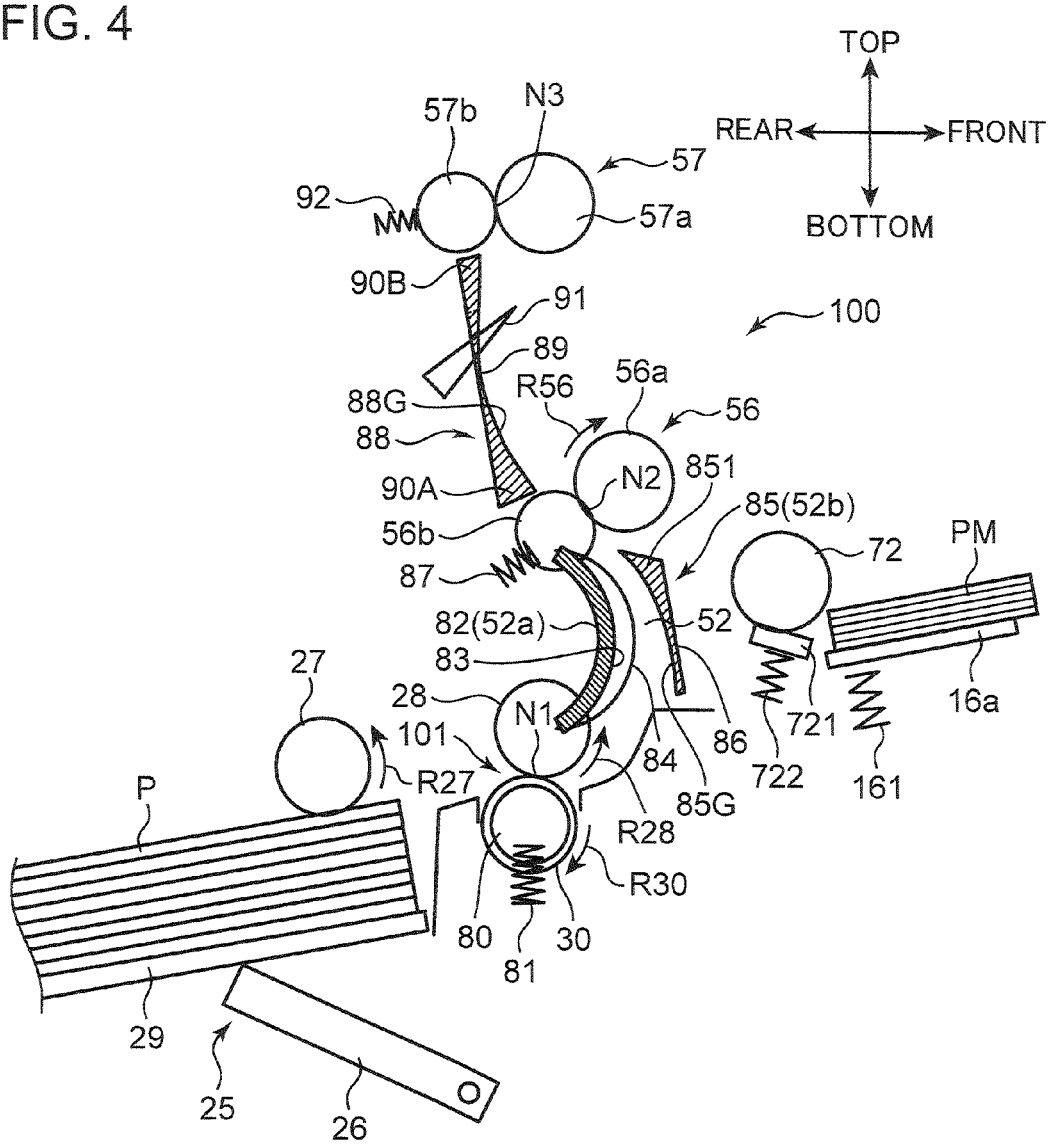
FIG. 4 is an enlarged schematic diagram showing a configuration of a sheet conveying path from a sheet feeding cassette to a pair of registration rollers.
Figure 5:
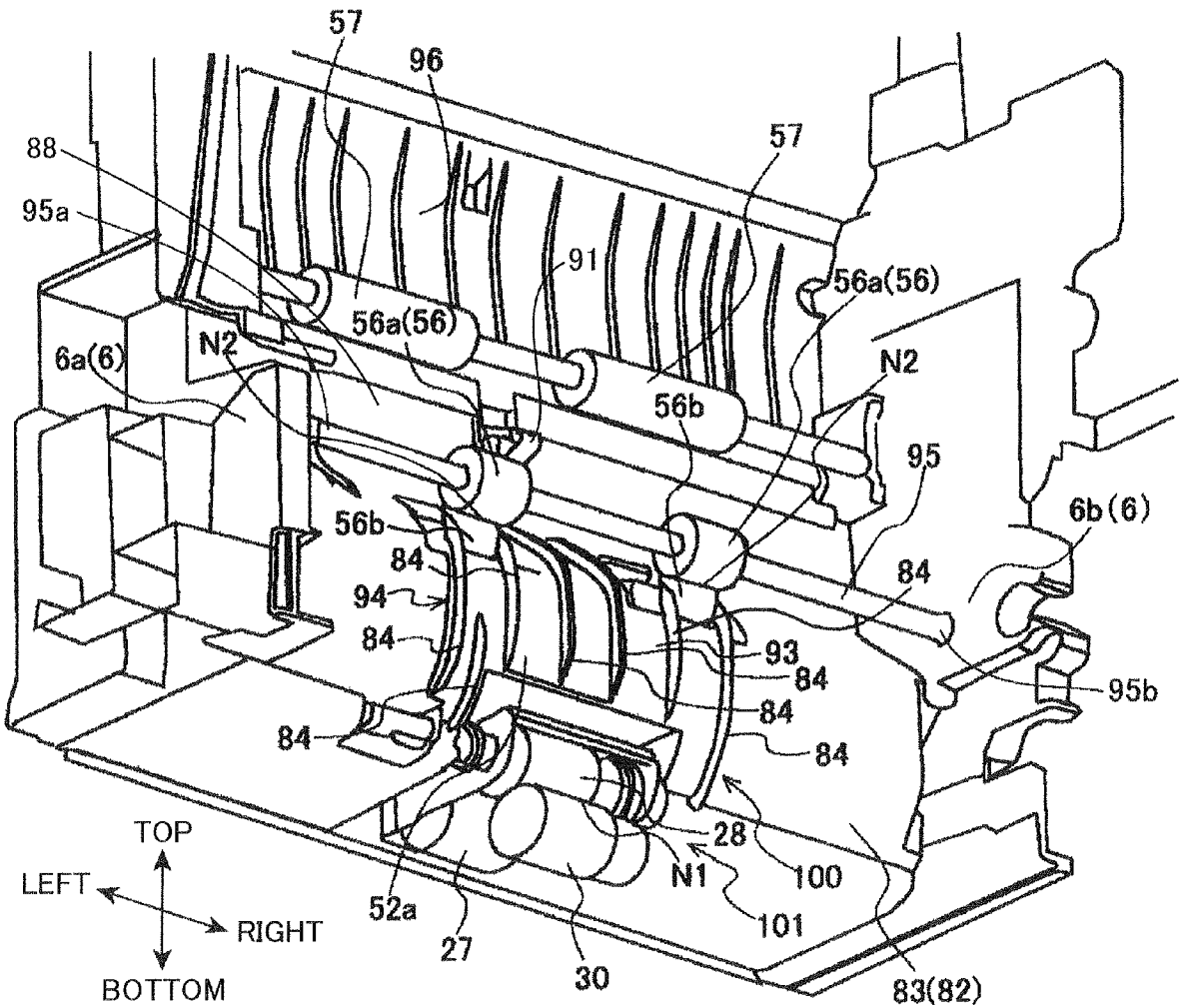
FIG. 5 is a perspective view showing a part of the open sheet conveying path from a sheet feeding roller to the pair of registration rollers.
Figure 6:
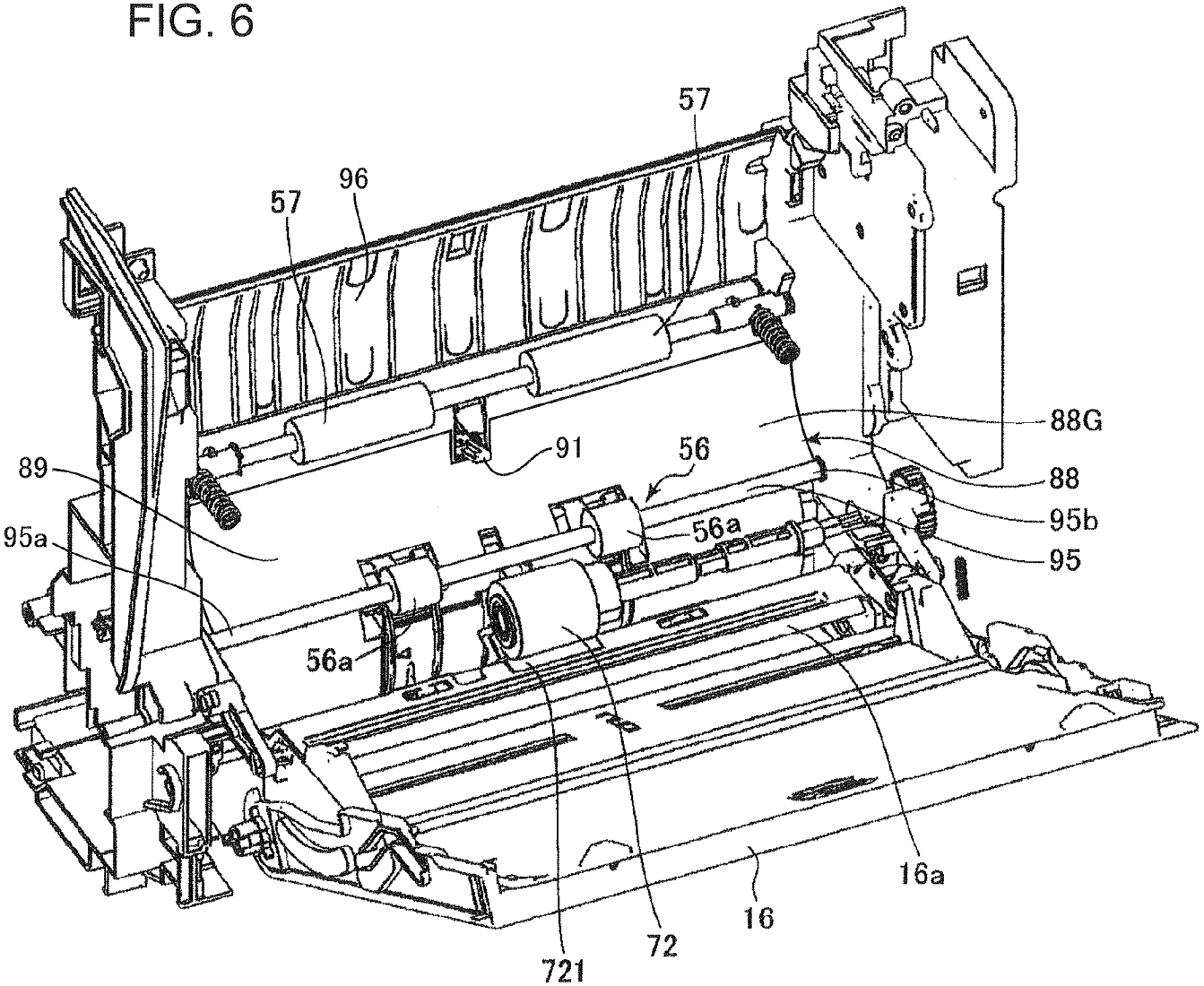
FIG. 6 is a perspective view showing a part of the open sheet conveying path from a manual sheet feeding roller to the pair of registration rollers.

Now, with reference to FIG. 4 to FIG. 8, the sheet conveying device 100 according to an embodiment of the present disclosure will be described. According to the present embodiment, the sheet conveying device 100 is applied to the sheet conveying path 52 from the sheet feeding cassette 25 to the pair of registration rollers 57. FIG. 4 is a diagram schematically showing the sheet conveying device 100. FIG. 5 is a perspective view showing a part of the open sheet conveying path 52 from the sheet feeding roller 28 to the pair of registration rollers 57. FIG. 6 is a perspective view showing a part of the sheet conveying path from the manual sheet feeding roller 72 to the pair of registration rollers 57.

With reference to FIG. 4, the sheet conveying device 100 includes the pair of registration rollers 57 (first pair of conveying rollers), the pair of conveying rollers 56 (conveying mechanism; a first pair of conveying rollers or a second pair of conveying rollers) that nips and conveys a sheet and that is arranged at a predetermined position (near a position midway between the pair of registration rollers 57 and the sheet feeding roller 28), a pair of rollers (conveying mechanism; a second pair of conveying rollers/hereinafter referred to as a "pair of sheet feeding rollers 101") of the sheet feeding roller 28 and the retard roller 30 which is disposed upstream of the pair of conveying rollers 56, and a manual sheet feeding roller 72.

As described above, the sheet conveying path 52 is a non-linear conveying path. Specifically, between the pair of sheet feeding rollers 101 and the pair of conveying rollers 56, the sheet conveying path 52 extends upward while being U-curved so as to protrude forward. In contrast, between the pair of conveying rollers 56 and the pair of registration rollers 57, the sheet conveying path 52 extends upward while being U-curved so as to protrude backward. Between the pair of sheet feeding rollers 101 and the pair of conveying rollers 56, a ribbed guiding plate 82 and a first guiding plate 85 (guiding plate) are arranged so as to define the sheet conveying path 52. Likewise, between the pair of conveying rollers 56 and the pair of registration rollers 57, a second guiding plate (guiding plate) is arranged so as to define the sheet conveying path 52.

A plurality of sheets P is loaded on a bottom plate 29 in a stacked shape in the sheet feeding cassette 25. The bottom plate 29 is biased upward by the lift plate 26 to keep the uppermost sheet P of the bundle of sheets in abutting contact with the pickup roller 27. Rotation of the pickup roller 27 in the direction of arrow R27 allows the sheet P to be fed toward a separating nip portion N1 between the sheet feeding roller 28 and the retard roller 30.

The retard roller 30 includes a torque limiter 80 installed thereon and is biased by a separation spring (compression spring) 81. A peripheral surface of the retard roller 30 is in abutting contact with a surface of the sheet feeding roller 28 to form a separating nip portion N1. When a single sheet P is fed from the pickup roller 27 to the separating nip portion N1, the retard roller 30, by the action of the torque limiter 80, rotates in the direction of arrow R30 in conjunction with the sheet P conveyed through the separating nip portion N1 by rotation of the sheet feeding roller 28 in the direction of arrow R28. On the other hand, if two or more sheets P are simultaneously fed to the separating nip portion N1, the retard roller 30 stops rotating to stop the second and subsequent sheets P from passing through the separating nip portion N1.

The ribbed guiding plate 82 forms an inner side wall of the U-curved sheet conveying path 52 between the pair of sheet feeding rollers 101 and the pair of conveying rollers 56. The ribbed guiding plate 82 forms a part of the rear side guide 52*a* of the sheet conveying path 52 shown in FIG. 3 and has a guiding surface 83 (protruding guiding surface) curved so as to protrude forward. A guide rib 84 projects from the guiding surface 83. Similarly to the guide plate 82, the guide rib 84 is disposed along a sheet conveying direction and curved so as to protrude forward. Furthermore, a plurality of the guide ribs 84 is disposed in the sheet width direction of the sheet P (see FIG. 5).

The first guiding plate 85 is arranged opposite the ribbed guiding plate 82 and forms an outer side wall (outer conveying surface) of the U-shaped conveying path. The first guiding plate 85 includes a first guiding plane 85G (guiding plane) on which a sheet is guided. The first guiding plane 85G is a plane curved so as to be recessed in association with the protruding surface shape of the guiding surface 83 and includes no guide rib or the like. The first guiding plate 85 includes a thinned portion 86 provided in an area against which a leading end of the sheet P in the conveying direction collides, to suppress high frequency components of an impulsive sound produced by the collision. The first guiding plate 85 will be described below with reference to FIG. 7.

The pair of conveying rollers 56 is arranged immediately downstream of the conveying path formed of the pair of the guiding plates 82 and 85. The pair of conveying rollers 56 includes a driving roller 56*a* rotationally driven in the direction of arrow R56 and a driven roller 56*b* with which the driving roller 56*a* comes into abutting contact by means of a compression spring 87, to rotate in conjunction with the driving roller 56*a*. A peripheral surface of the driving roller 56*a* and a peripheral surface of the driven roller 56*b* are compressed against each other to form a conveying nip portion N2 that nips and conveys the sheet P.

The second guiding plate 88 forms an outer side wall of the U-curved sheet conveying path 52 between the pair of conveying rollers 56 and the pair of registration rollers 57, which is arranged downstream of the pair of conveying rollers 56. The second guiding plate 88 forms a part of the rear side guide 52*a* of the sheet conveying path 52 shown in FIG. 3, and has a second guiding plane 88G (guiding plane) gently curved so as to be recessed backward. The second guiding plate 88 includes a detection sensor 91 disposed thereon to detect that the conveyed sheet P has reached the pair of registration rollers 57. The second guiding plate 88 will be described below with reference to FIG. 8.

The pair of registration rollers 57 includes a driving roller 57*a* and a driven roller 57*b* biased by a compression spring 92 in abutting contact with the driving roller 57*a*. A conveying nip portion N3 is formed between the driving roller 57*a* and the driven roller 57*b*. The pair of registration rollers 57 suspends the conveyance of the sheet P temporarily, carries out skew correction, and resumes the conveyance of the sheet P in association with transfer in the secondary transfer section T2 in a timely manner.

With reference to FIG. 4 and FIG. 6, the manual sheet feeding roller 72 is arranged to convey a manually inserted sheet PM from the manual insertion tray 16. A friction plate 721 is arranged opposite the manual sheet feeding roller 72. The friction plate 721 is biased toward the manual sheet feeding roller 72 by a bias spring 722, and forms a nip portion for picking up the sheet PM, together with the manual sheet feeding roller 72. A bias plate 16*a* is arranged upstream of the manual sheet feeding roller 72 to raise a leading end portion of the manually inserted sheet PM loaded on the manual insertion tray 16. The bias plate 16*a* is biased upward by a bias spring 161.

In the configuration of the sheet conveying device 100, the pair of sheet feeding rollers 101 separates only one sheet from the sheets P fed from the sheet feeding cassette 25 by the pickup roller 27, and the sheet P is fed into the sheet conveying path 52. The sheet P is subsequently guided by the ribbed guiding plate 82 and the first guiding plate 85 and reaches the pair of conveying rollers 56. The manually inserted sheet PM fed by the manual sheet feeding roller 72 travels over the first guiding plate 85 toward the pair of conveying rollers 56.

The sheet P (manually inserted sheet PM) is guided by the second guiding plate 88 while being conveyed by the pair of conveying rollers 56. A leading end of the sheet P is thus brought into abutting contact with the nip portion N3 formed by the pair of registration rollers 57, which has been stopped (sheet conveyance has been suspended temporarily). This corrects possible skew of the sheet P. The sheet P to which a conveying force is being applied by the pair of conveying rollers 56 is deflected while standing by upstream of the pair of registration rollers 57.

The sheet P is subsequently conveyed toward the secondary transfer section T2 by the pair of registration rollers 57 so as to reach the secondary transfer section T2 in a timely manner when a toner image formed on the intermediate transfer belt 31 shown in FIG. 3 reaches the secondary transfer section T2 in conjunction with rotation of the intermediate transfer belt 31 in the direction of arrow R31. At this time, the sheet P is guided by the guiding plate (see FIG. 5 and FIG. 6) arranged downstream of the pair of registration rollers 57. As described above, the toner image is secondarily transferred and further fixed to the sheet P conveyed to the secondary transfer section T2, and the resultant sheet P is discharged into the sheet discharge tray 10.

In the sheet conveying device 100 described above, the leading end of the sheet P in the conveying direction collides against the first guiding plane 85G of the first guiding plate 85 and the second guiding plane 88G of the second guiding plate 88, which define the outer side surfaces of the U-curved sheet conveying path 52. Furthermore, while a deflected portion of the sheet P is growing during skew correction by the pair of registration rollers 57, the deflected portion collides against the second guiding plane 88G. That is, an impulsive sound is produced when the sheet P passes along the first and second guiding planes 85G and 88G. Such an impulsive sound is unpleasant for the user. In particular, such a high-speed machine as is capable of processing more than 50 sheets per minute repeats producing an impulsive sound at a short period, further increasing an unpleasant feeling. Thus, in the present embodiment, the first guiding plate 85 and the second guiding plate are adapted to mitigate the impulsive sound. This will be described below.

Figure 7:
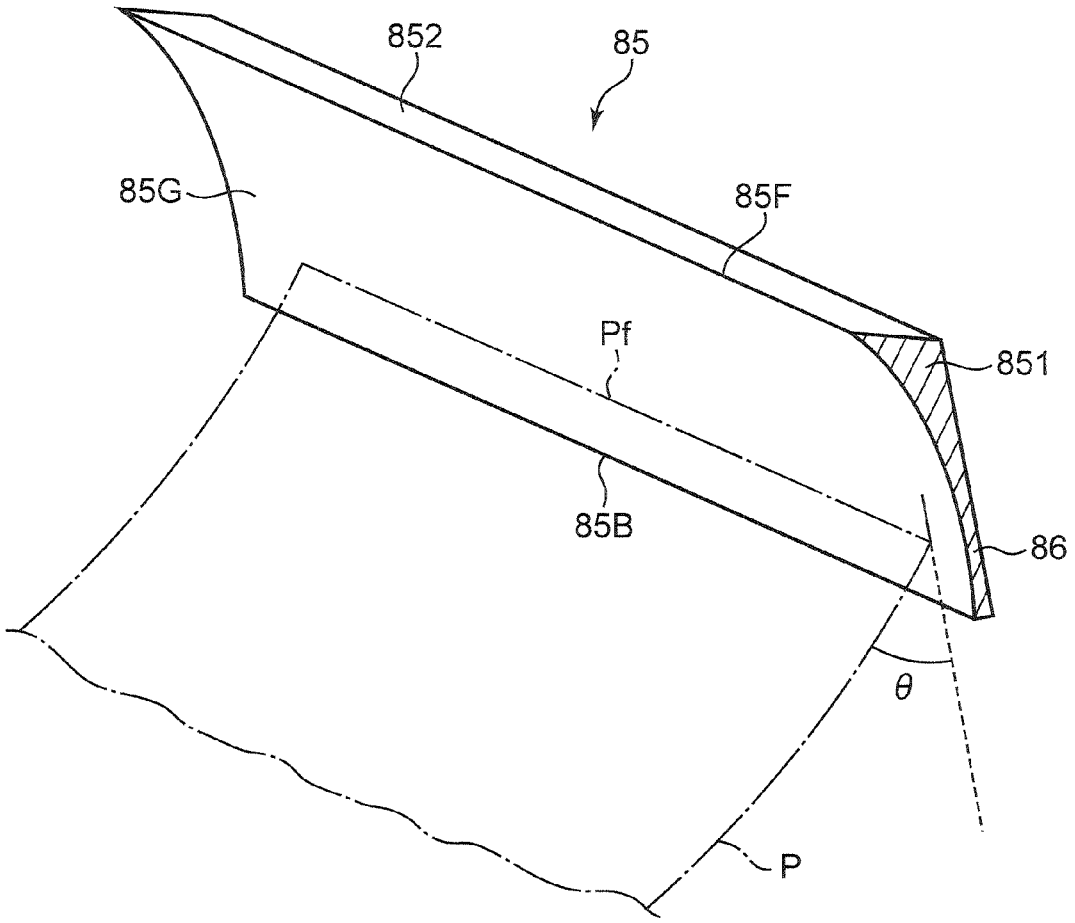
FIG. 7 is a perspective view showing a first guiding plate.

FIG. 7 is a perspective view of the first guiding plate 85. The first guiding plate 85 is a laterally long plate-like member and is lager in width than a sheet P with the maximum size fed through the sheet conveying path 52. A formation material for the first guiding plate 85 is preferably resin, and may be, for example, an acrylonitrile butadiene styrene copolymer (ABS) resin. The first guiding plane 85G is a curved plane gently curved from an upstream edge 85B to a downstream edge 85F of the first guiding plate 85 so as to be recessed. The thickness of the first guiding plate 85 is such that a thinned portion 86 is formed at the upper edge 85B side and that a thickened portion 851 is formed at the lower edge 85F side. That is, an approximately upstream half of the first guiding plate 85 in the conveying direction (a part of the guiding plane) is the thinned portion 86, whereas the thickened portion 851 has a thickness gradually increasing from a central portion to a downstream end of the first guiding plate 85 along the recessed curved surface.

The thinned portion 86 is arranged in an area against which a leading end Pf, in the conveying direction, of the sheet P conveyed along the sheet conveying path 52 collides. As seen in FIG. 4, since the sheet conveying path 52 is a U-shaped conveying path extending upward so as to protrude forward, the leading end Pf, in the conveying direction, of the sheet P fed into the sheet conveying path 52 by the pair of sheet feeding rollers 101 collides against the first guiding plane 85G, which forms the outer side wall of the U-shaped conveying path. The incident angle θ of the leading end Pf colliding against the first guiding plane 85G is closer to perpendicularity as the degree of curvature of the U shape of the sheet conveying path 52 increases.

After colliding against the thinned portion 86, the leading end Pf of the sheet P is guided to the conveying nip portion N2 of the pair of conveying rollers 56 by the thickened portion 851 of the first guiding plane 85G. After nipped by the conveying nip portion N2, the sheet P is nipped by the conveying nip portion N2 at the downstream side thereof in the conveying direction and by the separating nip portion N1 of the pair of sheet feeding rollers 101 at the upstream side thereof in the conveying direction. At this time, the sheet P fails to contact the first guiding plane 85G and comes into sliding contact with the guide rib 84 of the ribbed guiding plate 82, forming the inner side wall of the U-shaped conveying path. A rear surface guide 852 is formed on a rear surface of the thickened portion 851. The rear surface guide 852 guides the manually inserted sheet PM from the manual insertion tray 16 when the manually inserted sheet PM is conveyed into the pair of conveying rollers 56.

When the sheet P is conveyed between the pair of sheet feeding rollers 101 and the pair of conveying rollers 56, one surface of the sheet P is rubbed by the guide rib 84 curved so as to protrude, and a conveying rustle is produced. The present embodiment is adapted to reduce the conveying rustle. The pair of conveying rollers 56 includes the driving roller 56*a* and the driven roller 56*b*. However, the present embodiment has two roller pairs arranged at a predetermined distance from each other in the direction of the sheet passing width as shown in FIG. 5. The two driving rollers 56*a* are integrally fixed to a roller shaft 95 to form a roller member in which the driving roller 56*a* rotates in conjunction with rotation of the roller shaft 95. The roller shaft 95 is rotatably supported by a left side plate 6*a* of the main body frame 6 at an axially left end portion 95*a* thereof and by a right side plate 6*b* of the main body frame 6 at an axially right end portion 95*b* thereof.

In the two driving rollers 56*a*, an effective conveying width is defined by the distance between an outer end surface of the left driving roller 56*a* (a portion closest to the left end portion 95*a* of the roller shaft 95) and an outer end surface of the right driving roller 56*a* (a portion closest to the right end portion 95*b* of the roller shaft 95). When the effective conveying width is thus defined, the guide rib 84 is provided within an area corresponding to the effective conveying width. The present embodiment adopts the configuration in which the plurality of guide ribs 84 is provided on a base plate 93 and in which a guide rib unit 94 with a width corresponding to the effective conveying width is attached to the guiding surface 83. Areas of the guiding surface 83 positioned on the opposite sides of the effective conveying width are plain curved surfaces where no guide rib is arranged. When the ribbed guiding plate 82 as described above is used, the sheet P is rubbed only by the guide rib 84 positioned within the effective conveying width and not by any other guide rib even if the sheet P is conveyed in a pulling manner by the pair of conveying rollers 56 between the upstream pair of sheet feeding rollers 101 and the downstream pair of conveying rollers 56. This enables a corresponding reduction in possible conveying rustle compared to the conventional technique.

Figure 8:
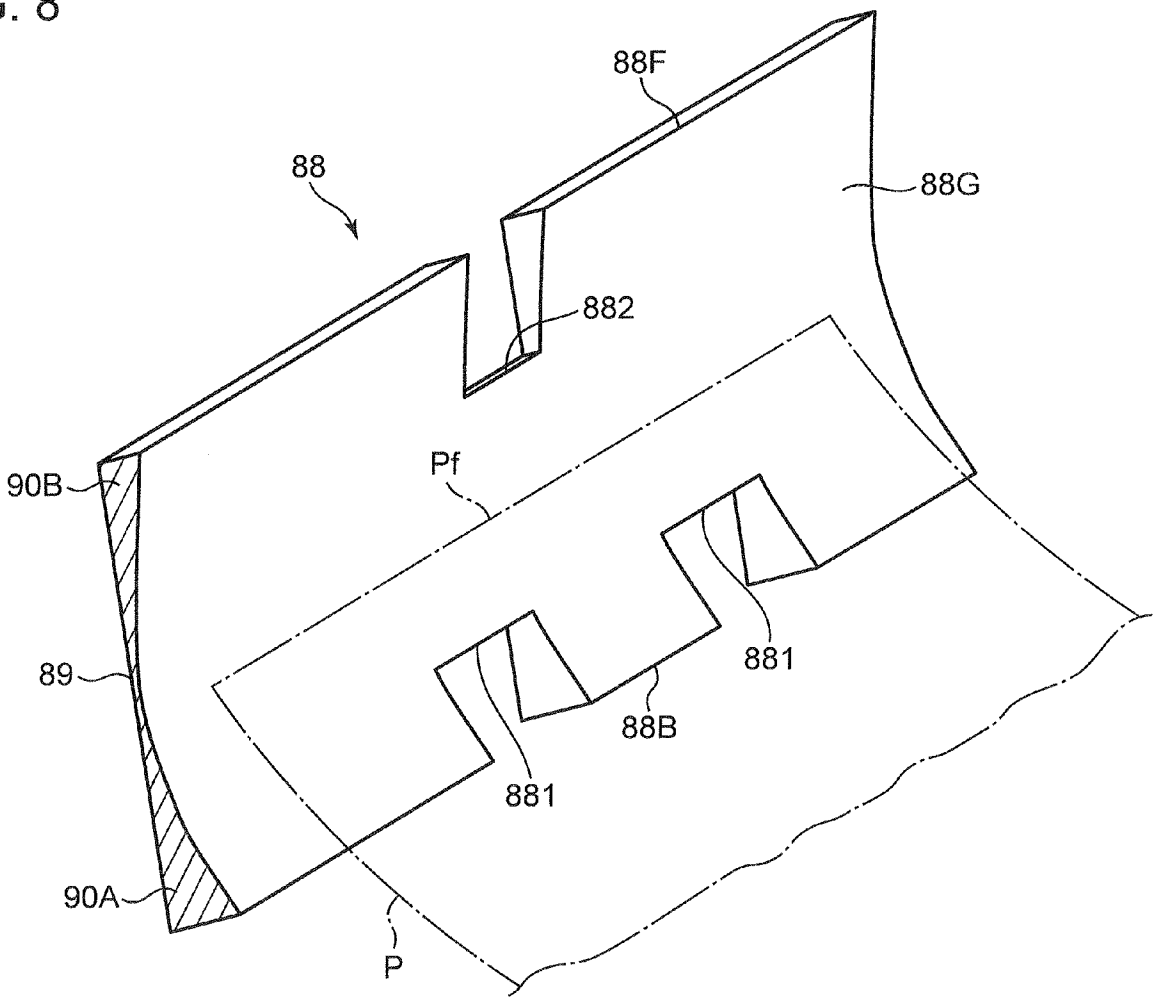
FIG. 8 is a perspective view showing a second guiding plate.

FIG. 8 is a perspective view of the second guiding plate 88. The second guiding plate 88 is also a laterally long plate-like member and is lager in width than a sheet P with the maximum size fed through the sheet conveying path 52. The second guiding plate 88 is also desirably formed of resin, for example, an ABS resin. The second guiding plane 88G is a curved plane gently curved from an upstream edge 88B to a downstream edge 88F of the second guiding plate 88 so as to be recessed. The thickness of the second guiding plate 88 is such that a thinned portion 89 is formed approximately in a central portion of the second guiding plate 88 in the sheet conveying direction and that thickened portions 90A and 90B are formed at the upstream edge 88B and downstream edge 88F sides. That is, the thickness gradually decreases from the upstream edge 88B of the second guiding plate 88 to the central portion along the recessed curved surface and gradually increases from the central portion to the downstream edge 88F along the recessed curved surface. Cutout portions 881 are formed at the upstream edge 88B side of the second guiding plate 88 to project the two rollers of the pair of conveying rollers 56 into the sheet conveying path 52. Furthermore, a cutout portion 882 is provided at the downstream edge 88F side to project the detection sensor 91 into the sheet conveying path 52.

The thinned portion 89 is arranged in an area against which the leading end Pf, in the conveying direction, of the sheet P (manually inserted sheet PM) conveyed toward the pair of registration rollers 57 by the pair of conveying rollers 56 collides. In the layout of the sheet conveying path 52 according to the present embodiment, the area against which the leading end Pf collides is located approximately in the central portion of the second guiding plate 88 in the sheet conveying direction. Thus, the thinned portion 89 is arranged in the central portion. After colliding against the thinned portion 89, the leading end Pf of the sheet P is guided by the thickened portion 90B of the second guiding plane 88G and comes into abutting contact with the nip portion N3 of the stopped pair of registration rollers 57. Subsequently, the pair of conveying rollers 56 continues to convey the sheet P, and thus, a deflected portion extending toward the second guiding plane 88G is formed on the sheet P. The deflected portion grows and collides against the thinned portion 89.

As described above, the first guiding plate 85 and the second guiding plate 88 include the thinned portions 86 and 89 in the areas against which the leading end Pf of the sheet P collides. This suppresses high frequency components of an impulsive sound produced by the collision of the sheet P. Thus, the quality of the impulsive sound can be modified and the sound can be reduced. This will be described below.

When an edge of a less rigid member such as a sheet collides against a relatively rigid flat surface, a certain impulsive sound is produced. The sound is produced by the sheet itself due to the collision. Such an impulsive sound contains a large number of frequency components. In noise in general, a sound with high frequency components contained in the noise makes human beings feel more unpleasant. Thus, the user's unpleasant feeling can be suppressed by enabling minimization of a sound with high frequency components contained in the impulsive sound, which has a very non-stationary property, by clarifying the relations among relevant structural parameters (design factors).

What frequency components an impulsive sound contains can be determined by analyzing the impulsive sound based on wavelet transformation. The wavelet transformation has the advantage of being able to decomposing, into scales (frequency components), a time-varying non-stationary sound such as an impulsive sound produced by a collision between the sheet and the guiding plate to extract the features of the sound.

As a result of experiments with evaluation of impulsive sounds based on the wavelet transformation, the present discloser has found that thinning the guiding plate in a part thereof against which the leading end of the sheet collides contributes to reducing characteristic and impactive high frequency components contained in a impulsive sound produced between the sheet and the guiding plate and depending on a change in impact angle. The thinned portions 86 and 89 of the first guiding plate 85 and the second guiding plate 88 are arrangements obtained based on the experiments. The thinned portions 86 and 89 are thinned in order to reduce the rigidity thereof compared to the other portions of the first guiding plate 85 and the second guiding plate 88. For example, if the first guiding plate 85 and the second guiding plate 88 are formed of an ABS resin, when the thickened portions 851, 90A, and 90B are assumed to be about 4 mm to 10 mm in thickness, the thinned portions 86 and 89 are formed to be about 1 mm to 2 mm in thickness. A plate formed of an ABS resin with a thickness of 1 mm has a strength and a durability sufficient to bear the impact of the sheet P. That is, a reduction in the rigidity of the thinned portions 86 and 89 is not intended to thin these portions to the degree that the portions are easily deformed.

Conventionally, the guiding surface coming into contact with the sheet is generally defined by a leading end surface of the guide rib. That is, like the ribbed guiding plate 82 according to the above-described embodiment, a common guiding plate includes a guide rib 84 extending upward from the guiding surface 83, serving as a base, so that the sheet comes into contact with the leading end of the guide rib 84. If such a common guiding plate is applied to a guiding surface against which the leading end of the sheet collides, the guiding plate is significantly thickened in the direction in which the sheet collides against the guiding plate. In this case, reducing high frequency components of the impulsive pound is difficult.

Thus, according to the present embodiment, the guiding surface of the guiding plate (first guiding plate 85 and second guiding plate 88) against which the leading end of the sheet in the conveying direction collides is formed to be a flat surface with no guide rib or the like (first guiding plane 85G and second guiding plane 88G). The first guiding plane 85G and the second guiding plane 88G are set substantially at the same positions as those of the conventional guiding surfaces defined by the leading ends of the guide ribs, and have a lateral width longer than the width of the sheet (in a direction orthogonal to the sheet conveying direction). In addition, the thinned portions 86 and 89 are provided in the area (a part of the guiding plane in the conveying direction) against which the leading end of the sheet in the conveying direction collides. The thinned portions also have a lateral width longer than the width of the sheet. These arrangements allow the sheet to collide against the thinned portions 86 and 89, which have no projection such as a guide rib all along the width direction thereof, thus reducing the high frequency components of the impulsive sound.

Figure 9A:
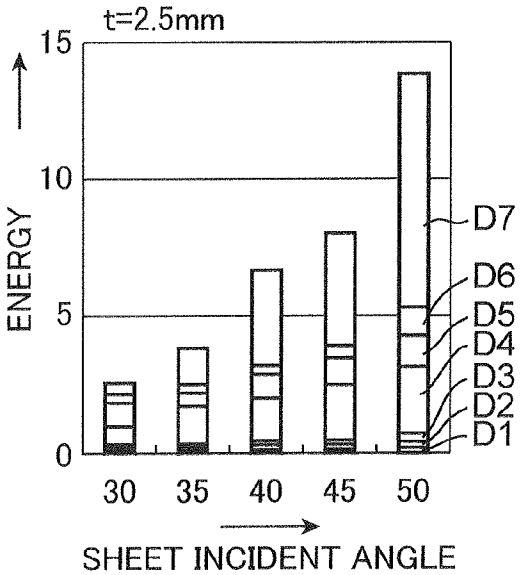
FIGS. 9A, 9B, and 9C are graphs showing how an impulsive sound was produced and in which measurement was made with the thickness of the guiding plate varied.
Figure 9B:
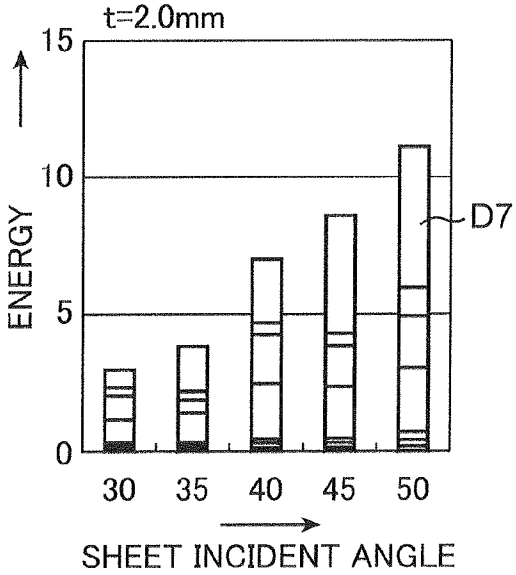
Figure 9C:
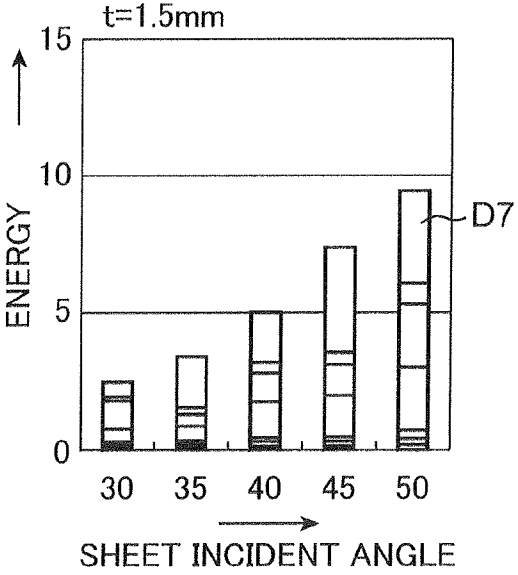

FIGS. 9A to 9C are graphs showing how impulsive sounds were produced when experiments were conducted in which the leading end of a sheet was allowed to collide against a guiding plane of a guiding plate formed of an ABS resin. FIG. 9A is a bar graph in which the area of the guiding plate against which the leading end of the sheet collided had a thickness t of 2.5 mm. FIG. 9B is a bar graph for t=2.0 mm, and FIG. 9C is a bar graph for t=1.5 mm. In the graphs, the axis of abscissas represents the incident angle θ (see FIG. 7) of the sheet with respect to the guiding plane, and the axis of ordinate represents, as energy, the average of the sums of squares of wavelet coefficient data at each level resulting from wavelet transformation. In the experiments, the linear velocity of the sheet was 300 mm/s, and the incident angle θ of the sheet was varied from 30 degrees to 50 degrees at intervals of 5 degrees. An impulsive sound produced in each case as recorded. As is apparent from the graphs, the overall energy increases as the sheet incident angle is closer to perpendicularity. The graphs also indicate that the overall energy decreases consistently with the thickness t of the guiding plate.

Figure 10:
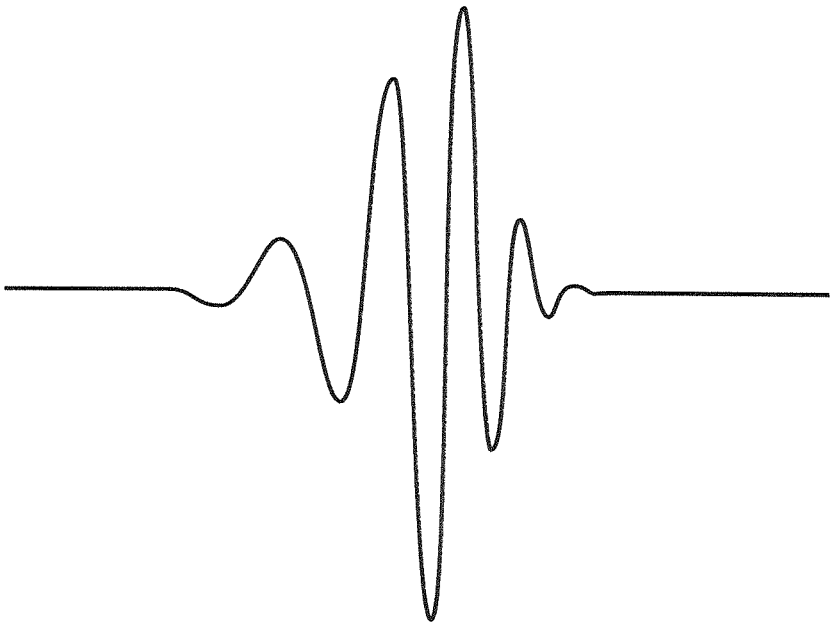
FIG. 10 is a diagram showing an example of a mother wavelet.

In the experiments, the frequency components of an impulsive sound obtained were determined by wavelet transformation of the impulsive sound. In this case, discrete wavelet transformation was used to make analysis up to a decomposition level 7. FIG. 10 shows a Daubechies 8 wavelet function used in the discrete wavelet transformation. In FIG. 9A to FIG. 9C, low scales (hereinafter referred to as high frequency components) D1 to D7 resulting from the decomposition and corresponding to the contents of each bar graph indicate energy at each decomposition level. FIG. 9A to FIG. 9C indicate that, of the high frequency components D1 to D7, D7 contributes most to the quality of the impulsive sound in connection with the angle of the incidence of the sheet on the guiding plate, and varies linearly.

In FIG. 9A to FIG. 9C, a comparison of a case where the sheet incident angle θ=50 degrees indicates that no significant change is observed for the levels D1 to D6 and that the sound energy at the level D7, dominated by high frequency components, decreases significantly and consistently with guiding plate thickness t in the following order: 2.5 mm, 2.0 mm, and 1.5 mm. The energy of the impulsive sound at t=1.5 mm is equivalent to energy suppressed to the same level as that at which the leading end of the sheet is allowed to collide against a guiding plate formed of expensive damping plastics. The degree of curvature of a sheet conveying path with a sheet incident angle θ of 50 degrees is often adopted for small image forming apparatuses.

As described above, the sheet conveying device 100 according to the present embodiment, the leading end Pf, in the conveying direction, of the sheet P conveyed along the sheet conveying path 52 collides against the thinned portions 86 and 89 of the first guiding plane 85G and the second guiding plane 88G, formed of planes with no ribs or the like. When the leading end Pf of the sheet P collides against the thinned portions 86 and 89, the thinned portions 86 and 89 serve to reduce the high frequency components of the impulsive sound compared to the portions with the normal thickness, as supported by the experiments. That is, the characteristic high frequency components of the impulsive sound produced by the collision of the sheet P can be suppressed to improve the quality of the impulsive sound so as to make the sound pleasant for the user. At the same time, the energy can be reduced to decrease the volume of the sound. Thus, the user's unpleasant feeling against the impulsive sound can be mitigated.

Furthermore, the first guiding plane 85G and the second guiding plane 88G with the thinned portions 86 and 89, respectively, define the outer conveying surfaces of the U-curved sheet conveying path 52. The leading end Pf of the sheet P in the conveying direction tends to collide hard against the outer conveying surfaces of the U-curved conveying path. Since the first guiding plane 85G and the second guiding plane 88G with the thinned portions 86 and 89, respectively, are arranged on the outer conveying surfaces, the impulsive sound can be effectively suppressed.

Moreover, the inner conveying surface of the U-curved sheet conveying path 52 is defined by the protruding guiding surface 83 of the ribbed guiding plate 82, which is curved so as to protrude. Thus, after the leading end Pf of the sheet P is nipped by the pair of conveying rollers 56, the sheet P is in sliding contact mainly with guiding surface 83 (guide rib 84) and avoids contacting the first guiding plane 85G, forming the outer conveying surface of the U-curved sheet conveying path 52. Thus, the thinned portion 86 is in contact mainly with the leading end Pf of the sheet P, and the sheet P and the thinned portion 86 are not constantly in contact with each other. This inhibits possible degradation of the thinned portion 86 resulting from sliding contact with the sheet P.

Furthermore, the deflected portion of the sheet P also comes into contact with the second guiding plane 88G of the second guiding plate 88, positioned immediately upstream of the pair of registration rollers 57. However, the thinned portion 89 is present in the portion with which the deflected portion comes into contact. Thus, the characteristic high frequency components of the impulsive sound can be reduced, allowing the user's unpleasant feeling to be suppressed.

In the above-described embodiment, the present disclosure is applied to the sheet conveying device in the image forming apparatus. The present disclosure is not limited to this, but is widely applicable to any sheet conveying device that conveys a sheet through a sheet conveying path set to include a nonlinear portion.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet conveying device comprising:

a sheet conveying path that includes a nonlinear portion, the nonlinear portion of the sheet conveying path defining a U-curved sheet conveying path;

a conveying mechanism arranged in the sheet conveying path to convey a sheet; and a guiding plate arranged in the nonlinear portion of the sheet conveying path and having a guiding surface along which the sheet is guided, the guiding surface defining an outer conveying surface of the U-curved conveying path and being curved gently from an upstream edge to a downstream edge so as to define a smooth concave surface with no guide rib formed thereon, the guiding plate including:

a thinned portion formed at approximately an upstream half of the guiding plate and having a substantially constant thickness; and a thick portion extending downstream from the thinned portion to the downstream edge, the thick portion gradually increasing in thickness from the thinned portion to the downstream edge along the concave surface, wherein the thinned portion is at an area of the guiding surface against which a leading end of the sheet being conveyed along the sheet conveying path collides so that the thinned portion suppresses high frequency components of an impulsive sound produced by the collision.

2. The sheet conveying device according to claim 1, wherein the conveying mechanism includes a first pair of conveying rollers arranged at a predetermined position in the sheet conveying path and a second pair of conveying rollers disposed upstream of the first pair of conveying rollers in a sheet conveying direction, each pair of rollers being a pair of conveying rollers nipping and conveying the sheet, and the U-curved conveying path is disposed between the first pair of conveying rollers and a second pair of conveying rollers.

3. The sheet conveying device according to claim 2, wherein an inner conveying surface of the U-curved conveying path is defined by a protruding guiding surface of a guiding member, the protruding guiding surface being curved to protrude.

4. The sheet conveying device according to claim 2, wherein the first pair of conveying rollers is a pair of conveying rollers suspending conveyance of the sheet temporarily, and the sheet stands by temporarily upstream of the first pair of conveying rollers, with a deflected portion being formed thereon and extending toward the guiding surface, and the deflected portion of the sheet also comes into contact with the thinned portion of the guiding plate.

5. The sheet conveying device according to claim 1, wherein the guiding surface has a width in a direction orthogonal to a sheet conveying direction that exceeds a width of the sheet in the direction orthogonal to the sheet conveying direction, and the thinned portion is thinner in a part of the guiding surface than in other parts of the guiding surface of the guiding plate in the conveying direction, and is wider than the conveyed sheet in the width direction.

6. The sheet conveying device according to claim 1, wherein the sheet conveying path includes a section extending upward while curving gently, and the guiding plate is in the section of the sheet conveying path that extends upward while curving gently.

7. The sheet conveying device according to claim 1, wherein the guiding surface is curved through an arc of less than 180°.

8. The sheet conveying device according to claim 1, wherein no part of the guiding plate is thinner than at the upstream end.

9. An image forming apparatus comprising:

an image forming section that forms an image on a sheet; and a sheet conveying device that conveys the sheet via the image forming section, the sheet conveying device comprising:

a sheet conveying path that includes a nonlinear portion, the nonlinear portion of the sheet conveying path defining a U-curved sheet conveying path;

a conveying mechanism arranged in the sheet conveying path to convey the sheet; and a guiding plate arranged in the nonlinear portion of the sheet conveying path and having a guiding surface along which the sheet is guided, the guiding surface defining an outer conveying surface of the U-curved conveying path and being curved gently from an upstream edge to a downstream edge so as to define a smooth concave surface with no guide rib formed thereon, the guiding plate including:

a thinned portion formed at approximately an upstream half of the guiding plate and having a substantially constant thickness; and a thick portion extending downstream from the thinned portion to the downstream edge, the thick portion gradually increasing in thickness from the thinned portion to the downstream edge along the concave surface, wherein the thinned portion is at an area of the guiding surface against which a leading end of the sheet being conveyed along the sheet conveying path collides so that the thinned portion suppresses high frequency components of an impulsive sound produced by the collision.

10. The image forming apparatus according to claim 9, wherein the conveying mechanism includes a first pair of conveying rollers arranged at a predetermined position in the sheet conveying path and a second pair of conveying rollers disposed upstream of the first pair of conveying rollers in a sheet conveying direction, each pair of rollers being a pair of conveying rollers nipping and conveying the sheet, and the U-curved conveying path is disposed between the first pair of conveying rollers and a second pair of conveying rollers.

11. The image forming apparatus according to claim 10, wherein an inner conveying surface of the U-curved conveying path is defined by a protruding guiding surface of a guiding member, the protruding guiding surface being curved to protrude.

12. The image forming apparatus according to claim 10, wherein the first pair of conveying rollers is a pair of conveying rollers suspending conveyance of the sheet temporarily, and the sheet stands by temporarily upstream of the first pair of conveying rollers, with a deflected portion being formed thereon and extending toward the guiding surface, and the deflected portion of the sheet also comes into contact with the thinned portion of the guiding plate.

13. The image forming apparatus according to claim 9, wherein the guiding surface has a width in a direction orthogonal to a sheet conveying direction that exceeds a width of the sheet in the direction orthogonal to the sheet conveying direction, and the thinned portion is formed to be thinner in a part of the guiding surface than in other parts of the guiding surface of the guiding plate in the conveying direction, and is wider than the conveyed sheet in the width direction.

* * * * *